United States Patent [19]

Hofstatter

[11] 4,208,223

[45] Jun. 17, 1980

[54] METHOD OF PAINTING ALUMINUM SURFACES

[75] Inventor: Alfred F. Hofstatter, Woodland Hills, Calif.

[73] Assignee: Superior Industries, Van Nuys, Calif.

[21] Appl. No.: 919,727

[22] Filed: Jun. 27, 1978

[51] Int. Cl.[2] ..... C23F 7/06

[52] U.S. Cl. ..... 148/6.2; 148/6.27; 427/387; 428/447

[58] Field of Search ..... 428/418, 447; 427/387; 148/6.27, 6.2

[56] References Cited

U.S. PATENT DOCUMENTS

| | | | |
|---|---|---|---|
| 2,471,909 | 5/1949 | Spruance | 148/6.2 |
| 3,935,349 | 1/1976 | Terai et al. | 148/6.27 |

*Primary Examiner*—Ralph S. Kendall

*Attorney, Agent, or Firm*—Fulwider, Patton, Rieber, Lee & Utecht

[57] ABSTRACT

A method is disclosed for the painting of aluminum surfaces that provides a highly superior coating than prior methods. The method comprises a controlled oxidation of the aluminum surface, the application to the oxidized surface of an epoxy functional silanol, and coating of the aluminum surface with paint by conventional methods such as brushing, spraying and the like. The useful epoxy functional silanols have the general formula of:

$$\underset{\underset{O}{\backslash\ /}}{CH_2CH}(CH_2)_n-O-(CH_2)_mSi(OH)_3$$

wherein:

n is a whole number integer of 1 through 3; and m is a whole number integer of 1 through 5.

These silanols can be applied to the oxidized aluminum surface by dissolving them, or their corresponding trialkoxysilanes, in an aqueous solution which is applied to the surfaces and permitted to dry or can be incorporated in the coating composition.

6 Claims, 3 Drawing Figures

METHOD OF PAINTING ALUMINUM SURFACES

BACKGROUND OF THE INVENTION

1. Field of Invention

This invention relates to the coating of aluminum surfaces and, in particular, to the use of a certain adhesion improver in the coating process.

2. Brief Statement of the Prior Art

Cast and machined aluminum surfaces such as used for automotive wheels are exposed to extremely severe conditions during normal applications. Specifications for adhesiveness of coatings on these surfaces are accelerated and severe weathering exposure such as water immersion, and exposure to subfreezing temperatures and high pressure steam. The coatings are subjected to scratching tests and to a peel strength test. The severity of this testing has, heretofore, precluded the painting of the exposed surfaces of cast and machine aluminum wheels for original manufacturer (OEM) use.

While it is recognized that certain hydrolyzable silanes which contain functional organic groups can be used as adhesion improvers in urethane coatings and as coatings on glass fibers and minerals used as fillers in reinforced plastics, these materials have not, previously, been employed for improving the adhesion of a variety of paints to the surface of aluminum which has received a controlled oxidation pretreatment.

BRIEF DESCRIPTION OF THE INVENTION

This invention comprises an improved method for the coating of aluminum surfaces such as the surfaces of cast and machined aluminum wheels for automotive application. The invention comprises the steps of cleaning and oxidizing the aluminum surfaces, preparatory to application of the adhesion improver and coating composition. The cleaning step for the machined surfaces include the use of a non-etching, silicate-free, sodium borate and phosphate cleaning solution. The cast metal surfaces are similarly cleaned and, in addition, receive a prior cleaning treatment with an alkaline phosphate etching solution.

After cleaning, the surfaces are thoroughly rinsed and oxidized by the application thereto of an acidic aqueous solution of a water soluble chromate. The excess chromate oxidizing agent is rinsed from the surfaces which are dried and the oxidized surfaces are then ready for treatment according to the invention. The conditions of the oxidation step are closely controlled to provide a uniform oxide surface on the aluminum.

The oxidized surfaces are contacted with an epoxy functional silanol of the following formula:

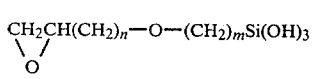

$$CH_2\underset{O}{\underset{\backslash\ /}{CH}}(CH_2)_n-O-(CH_2)_mSi(OH)_3$$

wherein:

n is a whole number integer of 1 through 3; and m is a whole number integer of 1 through 5.

The surfaces can be contacted with the aforedescribed silanol by dissolving the silanol or corresponding trialkoxysilane in water, spraying the solution on the surfaces, and draining and drying the surfaces; or by the addition of the corresponding silane to the paint composition.

The coating composition is applied to the oxidized aluminum surface in the presence of the aforedescribed silanol. The silanol functions to greatly improve the adhesiveness of the coating composition.

DESCRIPTION OF PREFERRED EMBODIMENTS

The aluminum surfaces which are coated in accordance with the method of the invention comprise cast or machined aluminum surfaces and, in particular, cast or machined aluminum wheels used for automotive vehicles. Most typically, the wheel is a cast aluminum product that is machined, as necessary for the required detailing.

Figure 1:
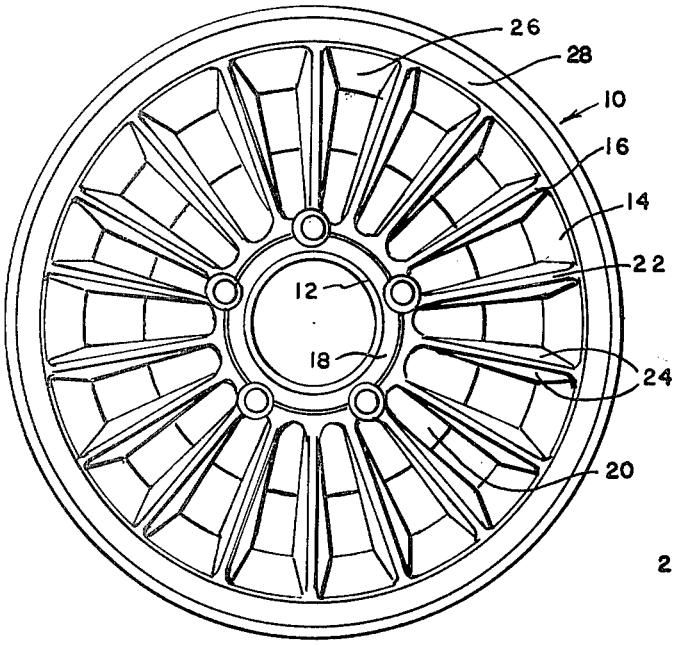
FIGS. 1 and 2 are views of a cast aluminum automotive wheel coated in accordance with the invention.
Figure 2:
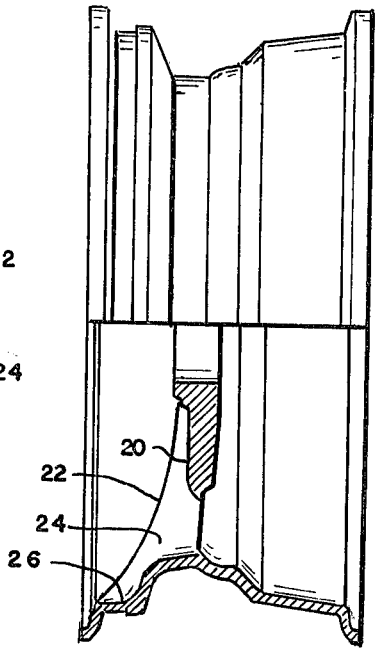

Referring now to FIGS. 1 and 2, a typical product treated in accordance with the invention is illustrated. This product comprises a cast aluminum wheel 10 having a hub 12 and a rim 14 joined by a plurality of cast veins 16. The hub 12 has a central machined surface 18 and a subjacent, peripheral portion 20. The latter portion has a cast surface.

Veins 16 have a machined face 22 with cast side surfaces 24. The inner portions of rim 14, designated as 26 also have a cast surface while the outer peripheral edge 28 of the rim has a machined surface.

The wheel is coated in accordance with the invention by applying a color base coating to the cast surfaces 20 of hub 12, the cast surfaces 26 of rim 14 and the cast surface sides 24 of veins 16. The entire wheel is also coated with a clear protective coating.

Figure 3:
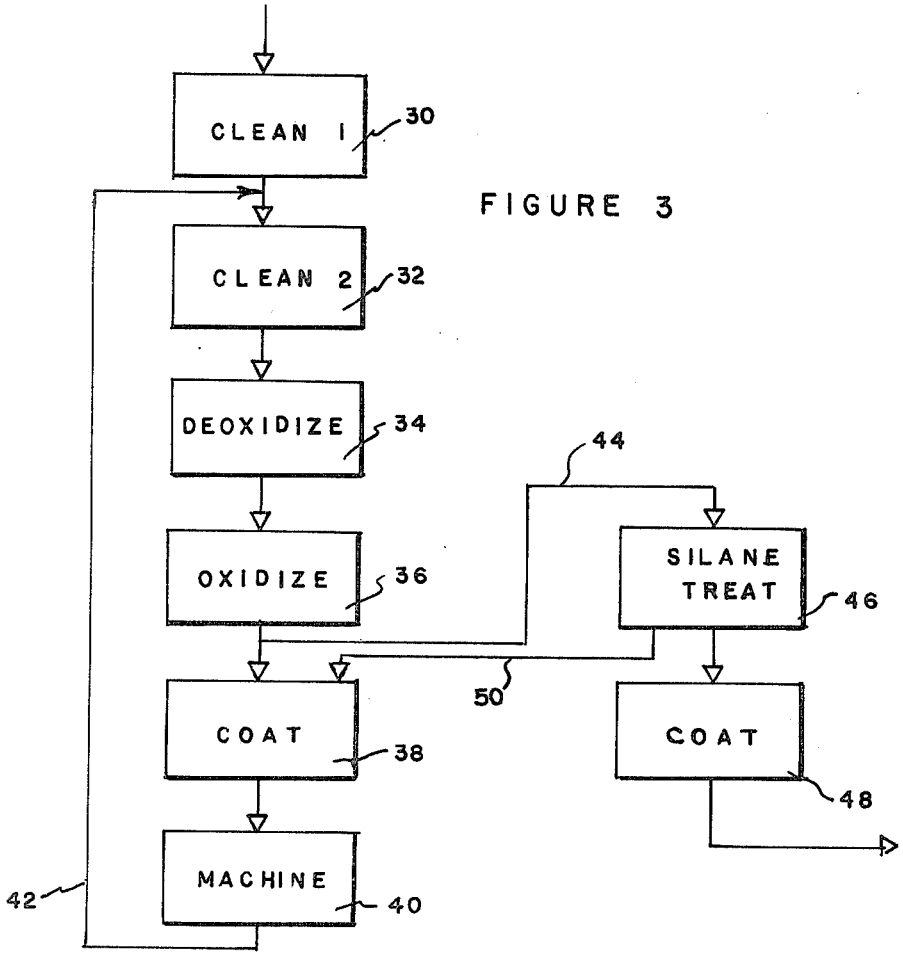
FIG. 3 is a block diagram of the treatment steps.

Referring now to FIG. 3, the method of treating the wheels in accordance with the invention will be described. The wheels after casting are conditioned for the application of a paint which contains a preselected color pigment. Prior to treatment, the wheels have received the cleaning, heat treatment and other customary treatments in preparation of a finished product. The wheels are then cleaned by treatment with an alkaline etching cleaner in a first treatment step 30. This treatment is performed by immersing or spraying the wheels into an aqueous solution from 2 to about 10, preferably about 5 volume percent of an alkali metal phosphate, typically trisodium orthophosphate having a pH of about 13.5. Suitable commercial products are available for this purpose such as Oakite STC, available from the Oakite Products, Inc., 50 Valley Road, Berkely Heights, N.J. Aluminum is etched by this material at a rate of about 0.5 inch per year. The wheels are maintained in the treatment bath for a limited period of time, typically from 2 to about 5, preferably about 3.5 minutes and the treatment cleans the wheels and etches the surfaces.

The wheels are rinsed by immersing or spraying in a rinse tank and thereafter sprayed with rinse water. The wheels are passed to treatment step 32 where they are cleaned in an aqueous solution of a non-etching, non-silicate cleaner. A suitable cleaner for this purpose is Oakite aluminum cleaner 166, which is a non-etching alkaline cleaner comprising a mixture of alkali metal phosphates and borates with a surface active agent and a corrosion inhibitors to prevent etching. Typically, the cleaner has a concentration from 2 to about 10 weight percent. The wheels are cleaned by immersing or spraying in the aqueous solution of this cleaner for a short period of time, from 1 to about 5, preferably in about 2.5 minutes. Following this treatment, the wheels are rinsed by immersing or spraying in a tank of rinse water and thereafter spray rinsed.

The cleaned wheels are then passed to treatment step 34 for a controlled deoxidation and removal of aluminum oxide and any discoloration. This treatment comprises immersing or spraying the wheels for a period of time from 1 to about 5, preferably about 2.5 minutes in an aqueous solution of an inorganic reducing agent such as an aqueous acidic solution of ferrous sulfate. A material which has been found suitable for this deoxidation treatment is Oakite deoxidizer LNC which is used at a concentration from 10 to 20 volume percent and has a pH value from about 0.8 to 1.0 percent. The wheels removed from the deoxidation treatment tank are then rinsed with a rinse water spray and are passed to the controlled oxidation treatment in step 36.

A suitable oxidation step comprises the contacting of the cleaned and freshly deoxidized aluminum surfaces with an aqueous solution of chromic acid having a pH no greater than about 4.5, typically from 2 to about 4.0. A commercially available material useful for this treatment is Alodine 1000, marketed by Amehem Products, Inc., Amber, Pa. The solution can be buffered by the presence of an alkali metal, e.g., sodium or potassium. The chromic acid is used in an aqueous solution having a concentration from 0.2 to about 2 weight percent, preferably about 0.6 weight percent. The treatment is conducted at ambient temperatures, e.g., from about 60° to about 100° F., preferably at about 80° F. and is performed by immersing or spraying the aluminum object such as the wheel into a bath of the aforedescribed aqueous chromate solution. The aluminum object is maintained in the bath for a period of from 1 to about 5, preferably from about 1 to about 3 minutes and is thereafter removed, and rinsed by immersion or spray in deionized water. The object then preceeds through one of two alternate courses. If it goes direct to step 38, coat, it is permitted to drain, and dried in an oven maintained in a flowing air stream at a temperature of from 200° F. to 250° F., preferably 200° F. This treatment provides a controlled and uniform oxide surface on the aluminum object that insures maximum adhesion of the coating composition.

The aluminum wheels which have been oxidized and provided with a controlled oxide coating in accordance with the invention are thereafter subjected to treatment with the silanol adhesion enhancer in step 38 shown in FIG. 2. The silane adhesion improver used in the invention has the following formula:

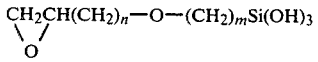

$$\underset{\diagdown\ \diagup\ O}{CH_2CH}(CH_2)_n-O-(CH_2)_mSi(OH)_3$$

wherein:

n is a whole number integer of 1 through 3; and m is a whole number integer of 1 through 5.

The silane can be added directly to the paint composition. A very suitable silane for this purpose is that which is marketed by Union Carbide Corporation, New York, N.Y. as A-187 which is gamma-glycidoxypropyltrimethoxysilane. The material can be used at a concentration of from 1 to about 10, preferably from about 3 to about 7 weight percent in a coating composition.

The silane can be incorporated in a variety of coating compositions. The coating composition can be a solvent base composition, typically a polyurethane base comprising a mixture of color base, polyurethane resin and solvent or thinner. A catalyst is added immediately prior to use of the composition. Suitable paint compositions for this purpose are available under the trade designation of Durathane DMU from Ditzler Automotive Finishes, Detroit, Mich. Another suitable coating composition which can be employed in combination with the silane for the combined surface treatment and coating step can be a water base composition such as a water soluble immulsion of a melamineacrylic-styrene polymer. Typically, the solvent employed for this composition is approximately 20 volume percent organic solvent and 80 volume percent water. The coating composition comprises a mixture of the aforementioned solvent, color base and resin base. A suitable water base coating composition is WPB-8805-3 marketed by Spraylat.

The other alternate course is shown as path 44 to step 46 in FIG. 3. After the oxidize; step 36, the object is rinsed in deionized water then treated with the silane, step 46, then on path 50 to coat, step 38. In this alternate course, no silane is added to the coating, but the silane is introduced directly to the surface in an aqueous solution.

The silanol can be obtained and used directly as an aqueous solution or, alternatively, the silanol can be obtained by dissolving a trialkoxysilane having alkoxy groups of from 1 to about 4 carbons in water since these silanes readily hydrolyze in aqueous solution to form the silanol active adhesion promoter.

Examples of suitable trialkoxy silanes which can be dissolved in water to prepare the silanol adhesion promoter comprise gamma-glycidoxypropyltrimethoxysilane, 1,2-epoxy-1-butylbutyltrimethoxysilane, 1,2-epoxy-5-amylpropyltrimethoxysilane, gammaglycidoxybutyltriethoxysilane, gamma-glycidoxypropyltripropoxysilane, 1,2-epoxy-3-butylpropyltrimethoxysilane, etc. Of the aforementioned, gamma-glycidoxypropyltrimethoxysilane is the preferred adhesion promoter used in the invention.

The silanol obtained from the aforementioned silane is contacted with the oxidized aluminum surfaces separately or jointly with the contacting of the surfaces by the coating composition. When the silanol is separately contacted with the surfaces, it is preferably employed as a spray of an aqueous solution containing from 0.05 to about 3 weight percent, preferably from 0.1 to about 0.5 weight percent of the aforementioned silanol.

In FIG. 2, the combined treatment of the wheel with the silanol adhesion promoter and coating composition is shown in step 38. The coating composition is cured in accordance with the manufacturer's specifications, typically an oven cure at a temperature from 180° to about 350° F. and for a period from about 20 to about 30 minutes is performed. After this treatment, the wheels are subjected to a machining operation to expose the machined and polished surfaces such as the surfaces 22, and 28 shown in FIG. 1. This is shown in step 40 of FIG. 3. Customary machining operations are performed on these surfaces including drilling and polishing as necessary to provide a highly polished and buffed surface suitable for subsequent treatment in accordance with the invention.

The wheels which have been machined to a polished surface are thereafter treated preparatory to the application of a clear, protective coating over these surfaces as well as the previously coated and unmachined surfaces 20, 24, and 26, shown in FIG. 1. The pretreatment comprises the reprocessing of the machined wheels through the second cleaning step, which is the treatment with the non-etching, non-silicate containing cleaning agent. This is shown in FIG. 2 by line 42 which indicates return of the machined wheels to treatment step 32. After this treatment, the wheels are removed deoxidized in the treatment step 34 and then given a controlled oxidation treatment in step 36, which are substantially identical to the treatments practiced on the cast wheels preparatory to the application of the paint, i.e., the color base coating.

Thereafter, the wheels are removed through line 44 and passed to a treatment with the silanol. While this treatment with the silanol can be substantially identical with that used with the paint composition, it is preferred that the silanol be applied as a pretreatment to the machined and cleaned surfaces in a step separate from application of the clear coating. For this purpose, any of the aforementioned silanols can be used which, of course, can be obtained by the addition of the corresponding silane to water to liberate the silanol by hydrolysis. Accordingly, the silanol treatment of the machined surfaces comprises treatment with an aqueous solution, containing from 0.05 to about 3, preferably from 0.1 to about 0.5 weight percent of the silane. The surfaces are treated preferably by spraying the aqueous solution onto the machined surfaces to wetness, i.e., until the solution films over the surfaces and drains therefrom. The surfaces are permitted to drain and then are dried in an oven exposed to an air temperature of from 200° to about 400°, preferably from 225° to about 275° F. for a period from about 5 to about 35, preferably about 20 minutes, to insure complete dryness. The length of this drying cycle can be increased, as necessary, depending upon the ambient humidity conditions and periods up to about 20 to about 45 minutes can be employed as needed.

After the wheels have been dried, they can then be clear coated in step 48 with the coating composition of the invention. The coating composition used for the clear coat compositon comprises an acrylic resin which is modified with a urethane. A suitable and commercially available for this purpose is marketed by Ditzler as Delclear DAU-75 modified with DXR-80, the latter comprising a urethane resin for modifying the acrylic resin. This mixture is used in approximately 16 to 1 volume proportions. The composition comprises a ketone solvent base and is applied by spray coating over the machined surfaces which have been pretreated with the silanol in step 46 of the invention as well as applied over the color base coated surfaces 26 and 24, previously mentioned. The coated wheels are thereafter subjected to the recommended curing steps as recommended by the manufacturer of the coating composition. Typically, this comprises passing the wheels through an oven for treatment at a temperature from 180° to about 350° F. in a heated air atmosphere. After the oven curing step, the finished wheels are completed and ready for packaging and marketing.

The invention has been described with reference to the presently preferred embodiment thereof. It is not intended that the invention be limited by this description of preferred embodiments. Instead, it is intended that the invention be defined by the means, and their obvious equivalents, set forth in the following claims:

What is claimed is:

1. A method for enhancing the adhesion of solvent and water base paints to the surface of aluminum which comprises:

(a) cleaning and deoxidizing the aluminum surface by contacting it with an aqueous solution of a reducing agent;

(b) oxidizing the aluminum surface to form a uniform coating of aluminum oxide thereon;

(c) incorporating in said paint from 1 to about 10 weight percent of an adhesion promoter of the formula:

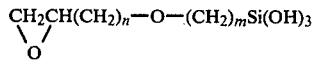

$$\underset{\diagdown\ \diagup \atop O}{CH_2CH}(CH_2)_n-O-(CH_2)_mSi(OH)_3$$

wherein:

n is a whole number integer of 1 through 3; and m is a whole number integer of 1 through 5; and (d) coating said surface with said paint.

2. The method of claim 1 including the step of cleaning said aluminum surface before said oxidizing step.

3. The method of claim 2 wherein said step of cleaning comprises treating said aluminum surface with a non-etching, alkali metal borate cleaner.

4. The method of claim 1 wherein said step of oxidizing comprises contacting said aluminum surface with an aqueous solution of chromic acid at a pH from 2 to about 4.5.

5. The method of claim 1 including the steps of rinsing and drying said aluminum surface after said oxidizing.

6. The method of claim 1 wherein said adhesion promoter is incorporated in said paint in an amount from 3 to about 7 weight percent.

* * * * *